US008811868B2

(12) United States Patent
Park et al.

(10) Patent No.: US 8,811,868 B2
(45) Date of Patent: Aug. 19, 2014

(54) FUSING UNIT AND IMAGE FORMING APPARATUS EMPLOYING THE SAME

(75) Inventors: Choong-kyu Park, Seoul (KR); Jae-hyuk Lim, Seoul (KR); Hwan-hee Kim, Hwaseong-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 534 days.

(21) Appl. No.: 13/086,059

(22) Filed: Apr. 13, 2011

(65) Prior Publication Data

US 2012/0082492 A1 Apr. 5, 2012

(30) Foreign Application Priority Data

Sep. 30, 2010 (KR) ..... 10-2010-0095700

(51) Int. Cl.
*G03G 15/20* (2006.01)

(52) U.S. Cl.
USPC ..... 399/320; 399/90; 399/122

(58) Field of Classification Search
USPC ..... 399/90, 122, 320
See application file for complete search history.

(56) References Cited

U.S. PATENT DOCUMENTS

| | | | | |
|---|---|---|---|---|
| 2006/0067754 | A1* | 3/2006 | Gilmore et al. | 399/333 |
| 2006/0127144 | A1* | 6/2006 | Watanabe | 399/329 |
| 2008/0003025 | A1* | 1/2008 | Tsunoda | 399/328 |
| 2009/0110452 | A1* | 4/2009 | Ogata | 399/331 |

FOREIGN PATENT DOCUMENTS

| | | | |
|---|---|---|---|
| JP | 11-338282 | | 12/1999 |
| JP | 2000-131983 | | 5/2000 |
| JP | 2001-036374 | | 2/2001 |
| JP | 2003076190 A | * | 3/2003 |
| JP | 2004-184886 | | 7/2004 |
| JP | 2008-33295 | | 2/2008 |
| JP | 2010-164636 | | 7/2010 |

OTHER PUBLICATIONS

European Search Report dated Dec. 19, 2011 issued in corresponding European Patent Application No. 11161375.8.

* cited by examiner

*Primary Examiner* — Ryan Walsh
(74) *Attorney, Agent, or Firm* — Staas & Halsey LLP

(57) ABSTRACT

A fusing unit and an image forming apparatus, the fusing unit includes: a fusing frame which is grounded to the image forming apparatus when mounted in the image forming apparatus; a heating member which includes a release layer contacting the print medium and a heat transfer layer provided within the release layer, grounded to the fusing frame, and transfers heat from a heat source provided therein to a print medium passing a predetermined fusing nip; a supporting member which rotatably supports the heating member; a pressure roller, forms the fusing nip between the pressure roller and the heating member, presses the print medium passing the fusing nip and includes a conductive material; and a discharging member includes an end part which contacts the print medium passing the fusing nip, and discharges static electricity from the print medium.

17 Claims, 8 Drawing Sheets

| TYPE | CLASSIFICATION | VALUE |
|---|---|---|
| ① | Max | 516V |
| | Min | −164V |
| | RMS | 83.5V |
| ② | Max | 34.0V |
| | Min | 10.0V |
| | RMS | 23.9V |

FUSING UNIT AND IMAGE FORMING APPARATUS EMPLOYING THE SAME

CROSS-REFERENCE TO RELATED APPLICATION

This application claims priority benefit from Korean Patent Application No. 10-2010-0095700, filed on Sep. 30, 2010 in the Korean Intellectual Property Office, the disclosure of which is incorporated herein by reference.

BACKGROUND

1. Field

Apparatuses and methods consistent with the exemplary embodiments relate to a fusing unit and an image forming apparatus employing the same, and more particularly, to a fusing unit and an image forming apparatus employing the same which prevents loss of an image and a contamination of a print medium due to a static electricity during a fusing operation.

2. Description of the Related Art

Generally, an electrophotographic image forming apparatus forms an electrostatic latent image by scanning light to an image carrier charged by a predetermined electric potential, develops such image with a predetermined toner, transfers and fuses such image on a paper and thereby prints an image. The electrophotographic image forming apparatus includes a transfer unit which transfers an image developed on the image carrier to a print medium and a fusing unit which fuses the image transferred to the print medium by heat and pressure.

FIG. 1 illustrates major parts of a conventional electrophotographic image forming apparatus.

As shown therein, the conventional electrophotographic image forming apparatus includes a transfer roller 3 which transfers a toner image T developed on an image carrier 1 to a print medium M, and a fusing unit 10 which fuses the toner image T transferred to the print medium M.

The fusing unit 10 includes a fusing belt 13 which has a heating lamp 11 mounted therein, a nip plate 15 which supports the fusing belt 13 to form a fusing nip N, and a pressure roller 17 which faces the nip plate 15, interposing the fusing belt 13 therebetween. The fusing belt 13 includes a non-conductive surface contacting the print medium M, and is charged by an electric potential having the same polarity as the toner image T on the print medium M and prevents an image from being transferred to the fusing belt 13 during a fusing operation. The fusing unit 10 heats and presses the non-fusing toner image T transferred to the print image to thereby fuse the toner image T on the print medium M when the print medium M passes the fusing nip N.

With the foregoing configuration, the image forming apparatus charges the print medium M with a high voltage by applying up to 3 kV voltage to a transfer roller 3 during a transfer process depending on the environmental conditions and the type of a print medium. Accordingly, the toner image T of the image carrier 1 is transferred to the print medium M in a transfer nip. If the print medium M is charged as above, a gap discharge can be generated from a front area of the transfer nip (area A in FIG. 1) and an image defect may occur. In consideration of the foregoing issue, the conventional image forming apparatus includes a discharging plate 5 which has an end part shaped like a saw tooth and applies a voltage to a print medium M before the print medium enters into the fusing nip N, and applies a voltage opposite in polarity to a charging voltage to the print medium M through the transfer roller 3 immediately after the transfer operation.

Applying a voltage through a discharging plate 5 lowers an adherence of the non-fused toner image T to the print medium M and causes blur or scattering, or the toner forming the image may be detached from the print medium M and scatter. The scattered toner may contaminate internal and external sides of the image forming apparatus and the print medium.

Also, static electricity is generated by friction between the fusing belt 13 forming the fusing nip N during the fusing process and the pressure roller 17 and the print medium M. If the generated static electricity is not controlled normally, a loss of an image may arise due to the static electricity from the fusing nip N. As a measure for preventing the loss of the image, a surface of the fusing belt 13 or the pressure roller 17 contacting the print medium M includes a conductive material, and is connected to the ground through a predetermined electrode in the conventional art. Otherwise, a voltage is applied through a power source 19 connected to the pressure roller 17 as shown in FIG. 1.

In the case of applying the voltage, a positive bias voltage of +100 to 1,000V is applied to the pressure roller 17 through the power source 19 so that the toner image T charged with a negative electric charge maintains its adherence to the print medium M. Then, the adherence of the toner image T to the print medium M increases, but the surface of the fusing belt 13 and the pressure roller 17 is charged with electricity by the applied voltage and easily contaminated by the toner or paper dust.

Particularly, immediately after the print medium M passes the fusing nip N, static electricity accumulated in the print medium M contacts a predetermined location P1 of the fusing belt 13 as shown in FIG. 2 and dozens of or thousands of electric potentials are discharged. The static electricity discharged as above remains in the surface of the fusing belt 13 including a non-conductive material and have properties different from other surfaces of the fusing belt 13. That is, the surface of the fusing belt 13 has a negative electric charge while the predetermined location P1 has a positive electric charge. Accordingly, when the fusing belt 13 rotates during the fusing process, the predetermined location P1 repeatedly faces the print medium as shown in FIG. 3. FIG. 3 illustrates a type ① and a type ② which represent a variation to a surface electric potential of the fusing belt 13 and a variation to the surface electric potential of the pressure roller 17, respectively, when the fusing belt 13 consecutively rotates. Referring to the surface electric potential of the fusing belt 13, it can be known that the maximum electric potential in the location P1 is +516V.

Accordingly, when the location P1 of the fusing belt 13 is located in the front side of the fusing nip N, the toner image charged with the negative electric charge is separated from the print medium M and attached to the fusing belt 13, and thus image separation and a white band or a black band may arise in another location of the print medium on a regular basis due to the separated image. Also, the separated image is attached to the pressure roller 17 and may contaminate a rear surface of the print medium M or another part of the print medium M.

A resistance of the print medium is changed depending on its type, thickness and environmental conditions. For example, in the case of a print medium which has a relatively high resistance property in a low-temperature and low-moisture environment, a voltage is applied to the pressure roller 17 corresponding to the resistance to overcome such resistance, and the problems due to the application of the voltage may worsen.

SUMMARY

Accordingly, one or more exemplary embodiments provide a fusing unit and an image forming apparatus employing the same which includes a non-power source, discharging configuration in a rear location of a fusing nip to replace a discharging plate between a transfer unit and a fusing unit and a configuration of applying a voltage artificially to thereby prevent a loss of an image and a contamination of a print medium.

The foregoing and/or other aspects may be achieved by providing a fusing unit which is mounted in an image forming apparatus and fuses an image transferred to a print medium, the fusing unit including: a fusing frame which is grounded to the image forming apparatus when mounted in the image forming apparatus; a heating member which includes a release layer contacting the print medium and including a non-conductive material and a heat transfer layer provided within the release layer, grounded to the fusing frame and including a conductive material, and transfers heat from a heat source provided therein to a print medium passing a predetermined fusing nip; a supporting member which rotatably supports the heating member; a pressure roller which is installed to be grounded to the fusing frame, forms the fusing nip between the pressure roller and the heating member, presses the print medium passing the fusing nip and comprises a conductive material; and a discharging member which is installed to be grounded to the fusing frame, includes an end part which contacts the print medium passing the fusing nip, and discharges static electricity from the print medium.

An end part of the discharging member may be located a predetermined distance (for example about 5.00 mm) away from a starting point toward an axis X if an end part of the fusing nip being escaped the print medium is referred to as the starting point and a segment connecting a center of the heating member and a center of the pressure member passing the contact location of the discharging member and the heating member is referred to as the axis X.

The release layer may include a non-conductive fluoropolymer.

A surface resistance of the pressure roller may range from about 105Ω to 107Ω.

The fusing unit may further include a bias plate which is provided in a first side of the pressure roller and electrically connected to the fusing frame, and a conductive brush which electrically connects the pressure roller and the bias plate.

The heating member may include a flexible endless belt, and the supporting member may face the pressure roller interposing the endless belt therebetween.

The heating member may rotate in association with a rotation of the pressure roller.

The foregoing and/or other aspects may be achieved by providing an image forming apparatus including: an image carrier; an exposing unit which forms an electrostatic latent image on the image carrier; a developing unit which develops a toner image with respect to the electrostatic latent image formed on the image carrier; a transfer unit which transfers to a print medium the toner image formed on the developing unit; and a fusing unit which fuses a non-fused toner image transferred to the print medium according to the above description.

The heating member may rotate in association with a rotation of the pressure roller.

BRIEF DESCRIPTION OF THE DRAWINGS

The above and/or other aspects will become apparent and more readily appreciated from the following description of the exemplary embodiments, taken in conjunction with the accompanying drawings, in which.

DETAILED DESCRIPTION

Figure 1:
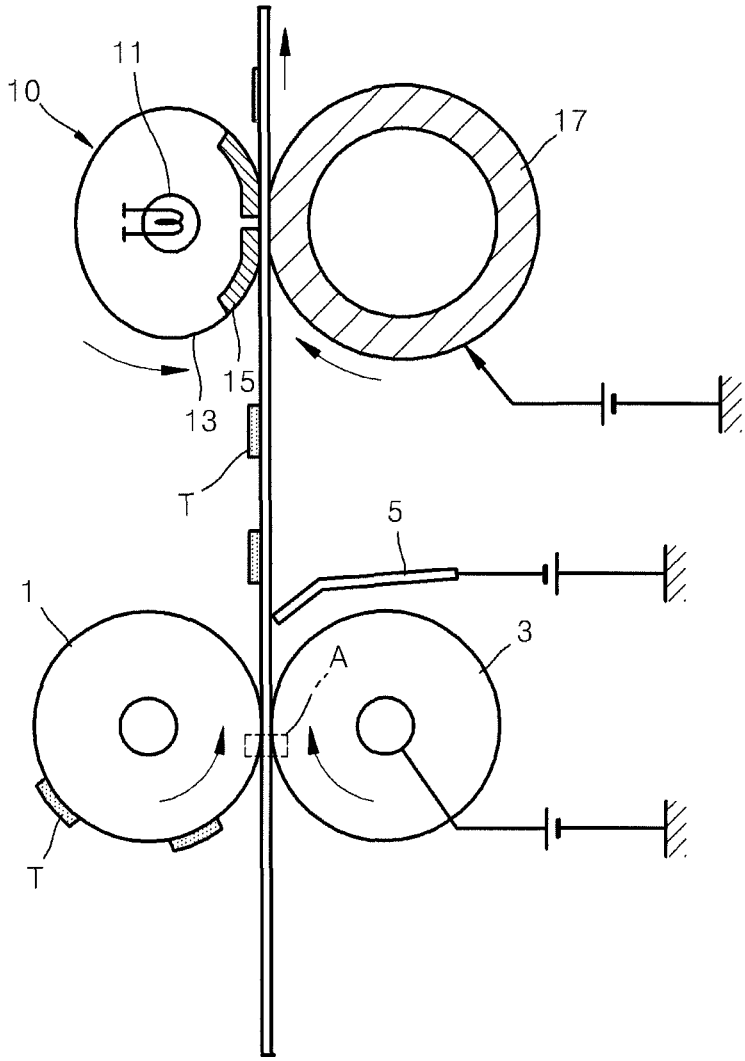
FIG. 1 (RELATED ART)
FIG. 1 illustrates major parts of a conventional electrophotographic image forming apparatus.

Below, exemplary embodiments will be described in detail with reference to accompanying drawings to be easily realized by a person having ordinary knowledge in the art. The exemplary embodiments may be embodied in various forms without being limited to the exemplary embodiments set forth herein. Descriptions of well-known parts are omitted for clarity, and like reference numerals refer to like elements throughout.

Figure 4:
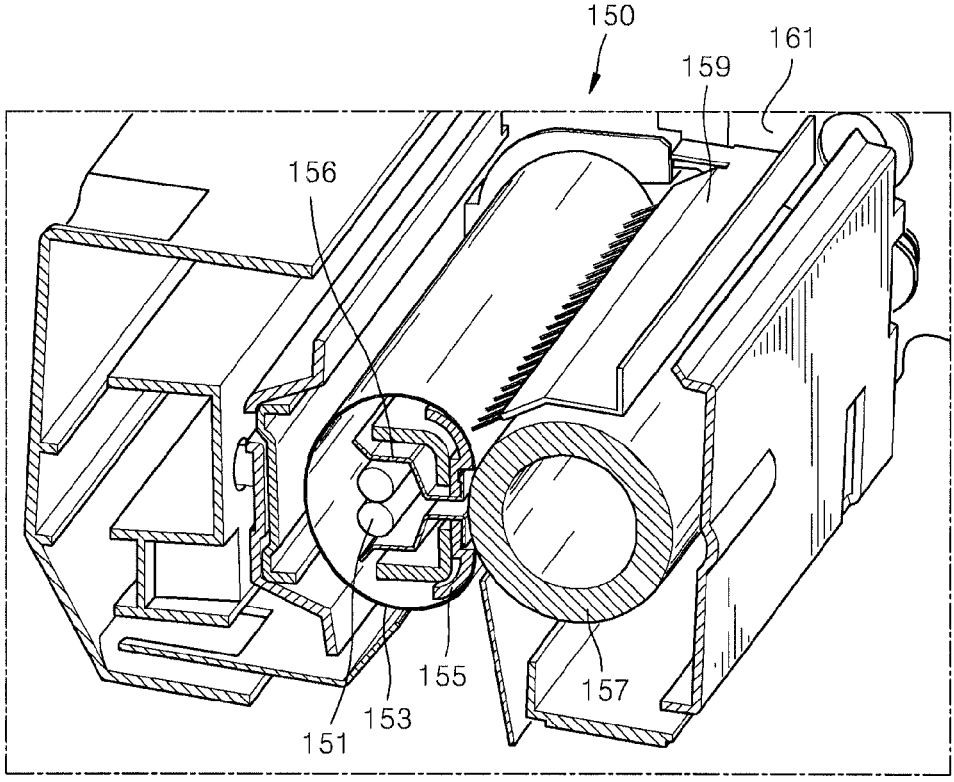
FIG. 4 is a partial sectional perspective view of the fusing unit according to an exemplary embodiment.
Figure 5:
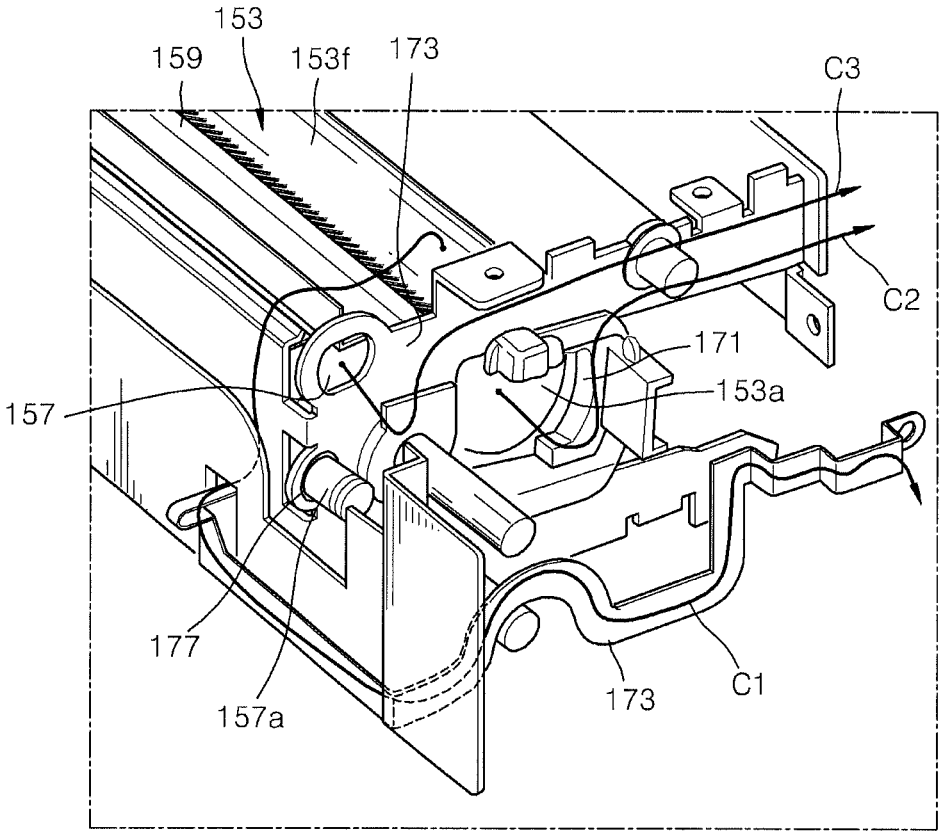
FIG. 5 illustrates an electrostatic control of the fusing unit according to the exemplary embodiment.

FIG. 4 is a partial sectional perspective view of a fusing unit according to an exemplary embodiment. FIG. 5 illustrates an electrostatic control of the fusing unit.

The fusing unit according the exemplary embodiment is mounted in an image forming apparatus and fuses a toner image transferred to a print medium M. Referring to FIG. 4, the fusing unit includes a heat source 151, a heating member 153, a supporting member 155, a pressure roller 157, a discharging member 159 and a fusing frame 161 which supports the foregoing elements and forms a ground path to control a static electricity of the fusing unit.

The fusing frame 161 is grounded to a ground terminal (not shown) of the image forming apparatus when the fusing unit 150 is mounted in the image forming apparatus.

The heating member 153 faces, and is rotatably supported by, the pressure roller 157 interposing a print medium M therebetween, and guides a transfer of the print medium M passing a predetermined fusing nip. Also, the heating member 153 transmits heat from the heat source 151 to the print medium M.

Figure 7:
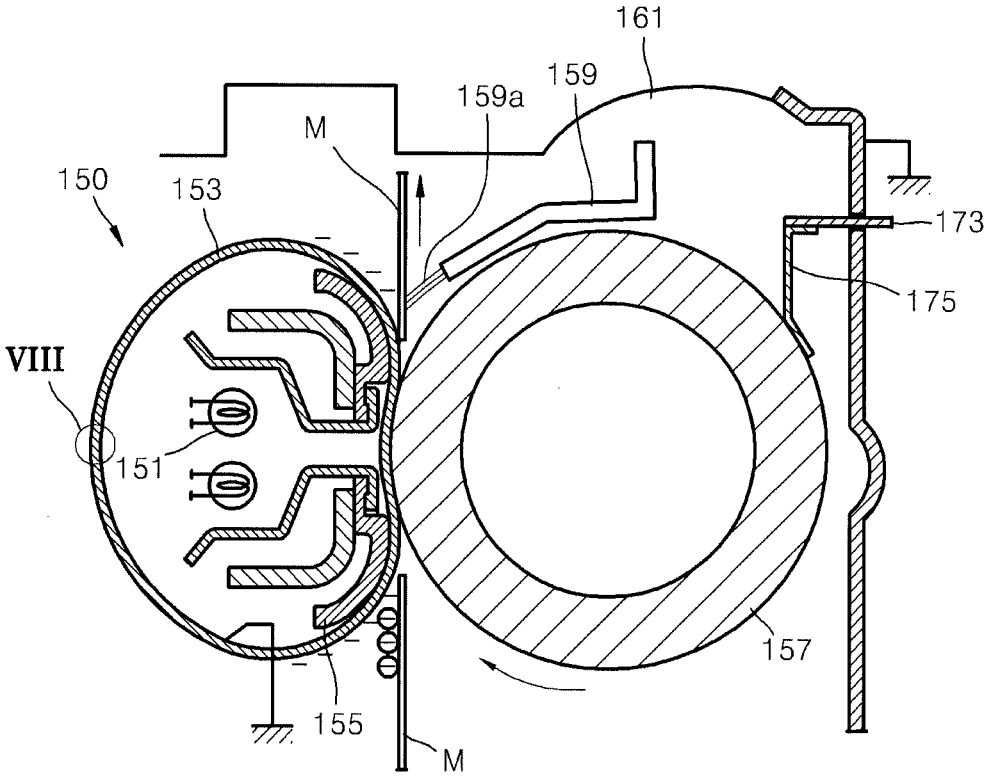
FIG. 7 illustrates a variation to an electric potential of a print medium and a variation to a surface electric potential of a heating member of the fusing unit according to the exemplary embodiment.
Figure 8:
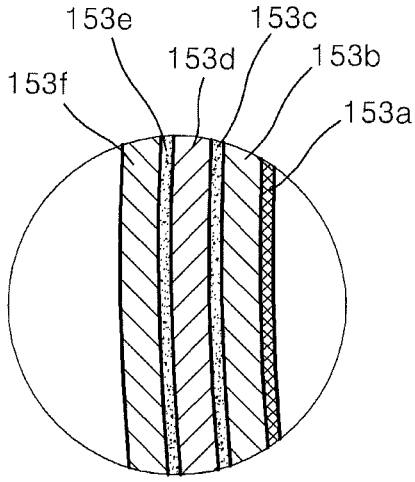
FIG. 8 illustrates a sectional view of the heating member of the fusing unit according to the exemplary embodiment.

Referring to FIG. 8, (pointed out by VIII of FIG. 7) the heating member 153 includes a heat transfer layer **153*b* which is provided to face the heat source 151 and absorbs heat from the heat source 151, and a release layer 153*f* which is formed in an outside of the heat transfer layer 153*b* and releases the print medium M during the fusing operation. The release layer 153*f* directly contacts the print medium M and includes a non-conductive material. That is, the release layer 153*f* may include a non-conductive fluoropolymer as the non-conductive material. If the release layer 153*f*** includes the non-conductive material as above, it is charged with a predetermined electric potential (e.g., negative electric charge) by static electricity arising from the fusing process.

The heat transfer layer 153*b* includes a conductive material such as stainless steel (SUS), and an internal surface 153*a* is coated in black to improve heat absorption. The heat transfer layer 153*b* is grounded to the fusing frame 161 through a predetermined ground path C2 (refer to FIG. 5) and maintains its ground state during the fusing process. Referring to FIG. 5, a first bushing 171 which rotatably supports the heating member 153 may form a ground path between the heat transfer layer 153*b* and the fusing frame 161. The first bushing part 171 may have a surface resistance of about 105Ω or less to efficiently transfer electricity.

The release layer 153*f* is a non-conductive layer, and forms a control circuit through a predetermined conductive path C1 (refer to FIG. 5) from a surface of the pressure roller 157 to a bias plate 173 to the fusing frame 161. The fusing unit may further include a conductive brush 175 which is provided between the surface of the pressure roller 157 and the bias plate 173 and electrically connects the surface of the pressure roller 157 and the bias layer plate 173. The conductive brush 175 is installed in the bias plate 173 and contacts the surface of the pressure roller 157 that is rotatably driven.

The heating member 153 may further include a base layer 153*d* which is provided between heat transfer layer 153*b* and the release layer 153*f* and maintains a strength of the heating member 153; and primer layers 153*c* and 153*e* which are provided between the heat transfer layer 153*b* and the base layer 153*d* and between the base layer 153*d* and the release layer 153*f*, respectively, and connect the foregoing layers.

As shown in FIG. 4, the heating member 153 may include a flexible endless belt which is easily deformed by its weight or external force. In this case, a fusing nip is formed in a predetermined width or more by pressure between the supporting member 155 and the pressure roller 157. The material of the heating member 153 need not be a flexible material and may further include a roller type body.

The supporting member 155 is installed in the heating member 153 and faces the pressure roller 157, interposing the heating member 153 therebetween. In this case, the heating member 153 rotates in association with a rotation of the pressure roller 157.

The fusing unit according to the embodiment may further include a heat conductive unit 156. The heat conductive unit 156 includes a pair of heat conductive layers which face each other, interposing the heat source 151 therebetween, and transfer radiant heat from the heat source 151 to the fusing nip.

The pressure roller 157 is installed to be grounded to the fusing frame 161, forms the fusing nip between the pressure roller 157 and the heating member 153, and presses the print medium M which passes the fusing nip.

The pressure roller 157 may include a conductive material, a surface resistance of which is about 105Ω to 107Ω. If the pressure roller 157 includes the conductive material whose surface resistance ranges about 105Ω to 107Ω as above, the surface has a negative electric charge which is lower than the release layer 153*f* of the heating member 153, and increases the adherence of the toner to the print medium M and prevents an excessive amount of negative electric charges from accumulating through the ground path.

The pressure roller 157 is grounded to the fusing frame 161 through a predetermined ground path C3 (refer to FIG. 5) and maintains its ground state during the fusing process. Referring to FIG. 5, a rotational shaft 157*a* of the pressure roller 157 and a second bushing part 177 rotatably supporting the rotational shaft 157*a* form the ground path between the pressure roller 157 and the fusing frame 161. The second bushing part 177 may have a surface resistance of about 105Ω or less to transmit electricity without difficulty.

The discharging member 159 is installed to be grounded to the fusing frame 161, has a first end contacting the print medium M passing the fusing nip, and discharges static electricity from the print medium M. As the discharging member 159 is installed, excessive static electricity of a rear end of the print medium discharged from the fusing nip may be removed. Accordingly, static electricity of the print medium M is prevented from being discharged to the release layer 153*f* of the heating member 153 to thereby prevent a loss of an image. The discharging member 159 includes a discharging brush 159*a* contacting the print medium M to thereby prevent the print medium M from being damaged during the electricity discharging process.

Figure 3:
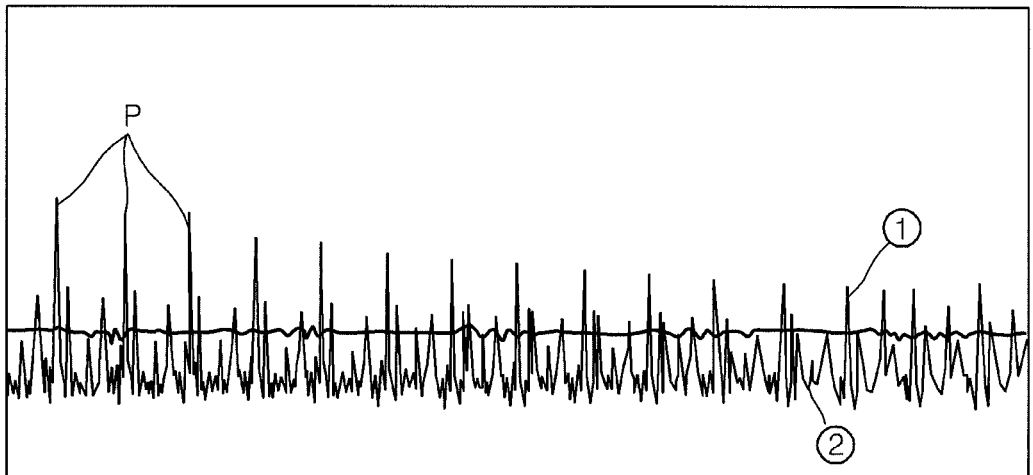
FIG. 3 is a graph which illustrates variations of surface electric potentials of a fusing belt and a pressure roller when the fusing belt in FIG. 2 rotates.
Figure 6:
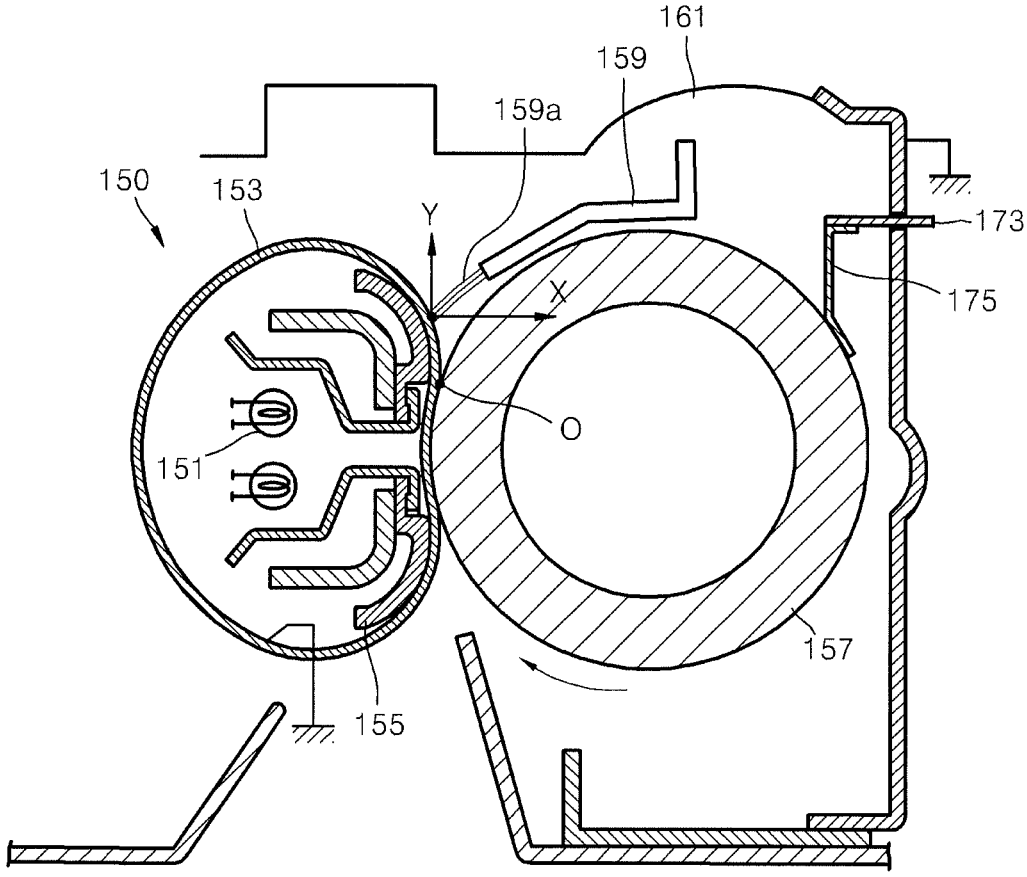
FIG. 6 illustrates a location of a discharging member of the fusing unit according to the exemplary embodiment.

As the discharging performance of the discharging member 159 depends upon the location of the discharging brush 159*a* when the discharging member 159 is installed in the fusing frame 161, the installation location of the discharging member is determined in consideration of the foregoing fact. Referring to FIG. 6, when an end part of the fusing nip being escaped the print medium M is referred to as a starting point O, an end part of the discharging member 159 (a point where the axis X and the axis Y cross each other) may set to be located, for example, about 5.0 mm away from the starting point O toward the axis X, according to an embodiment. However, it is not limited thereto. The axis X means a segment in parallel with a segment connecting the center of the heating member 153 and the center of the pressure roller 157, passing the contact location of the discharging member 159 and the heating member 153. If the end part of the discharging member 159 is out of the scope toward the axis X, the surface electric potential of the heating member 153 drastically fluctuates between positive values and negative values depending on the passing location of the print medium M, and may cause the distribution of the surface electric potentials as shown in FIG. 3.

With the foregoing configuration, an electrostatic control of the fusing unit will be described hereinafter.

During the fusing operation, the heating member 153 and the pressure roller 157 continuously generate negative electric charges by rotation and friction and prevent the non-fusing toner from being attached to the surface thereof. A surface of the print medium M on which an image is formed faces the heating member 153, and the heat transfer layer 153*b* provided inside of the heating member 153 is connected to the ground and static electricity generated from the internal friction is prevented from being accumulated excessively.

The pressure roller 157 includes the conductive material with a predetermined resistance, and thus has a negative electric charge which is lower than the release layer 153*f* of the heating member 153 and increases the adherence of the toner to the print medium M. Further, the pressure roller 157 is grounded through the predetermined ground path and prevents accumulation of excessive negative electric charges.

Figure 2:
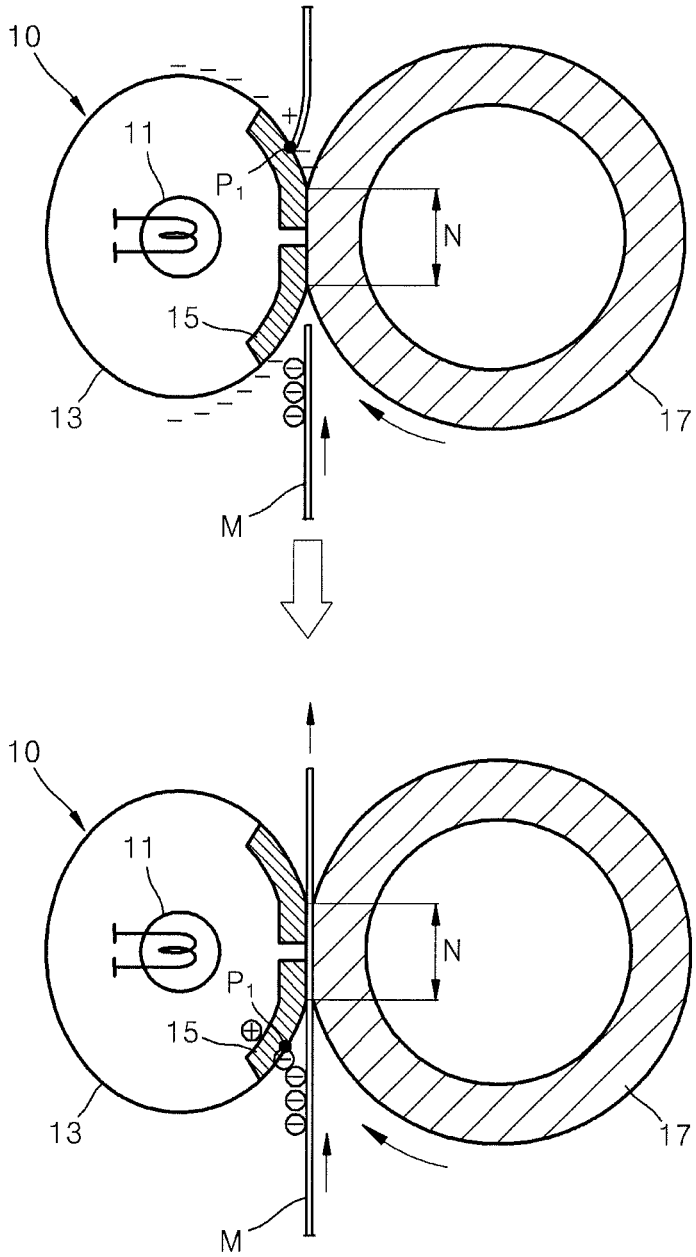
FIG. 2 (RELATED ART)
FIG. 2 illustrates the cause of a defective image of a fusing unit applying an artificial electric potential to a conventional pressure roller.

The discharging member 159 prevents the rear end of the print medium from being discharged between the heating member 153 and the discharging member 159 while passing an escaping end part of the fusing nip. Referring to FIG. 7, as the surface electric potential of the print medium M passing the rear end part of the fusing nip is discharged by the discharging member 159, the change of the polarity of the surface electric potential in the specific location of the heating member 153 as in FIG. 2 may be prevented. Accordingly, the defect of the image due to the drastic change in the polarity of the surface electric potential of the heating member 153 may be prevented ultimately.

The fusing unit which is provided as above may replace the discharging plate provided between the transfer unit and the fusing unit, and the configuration applying the voltage.

Figure 9:
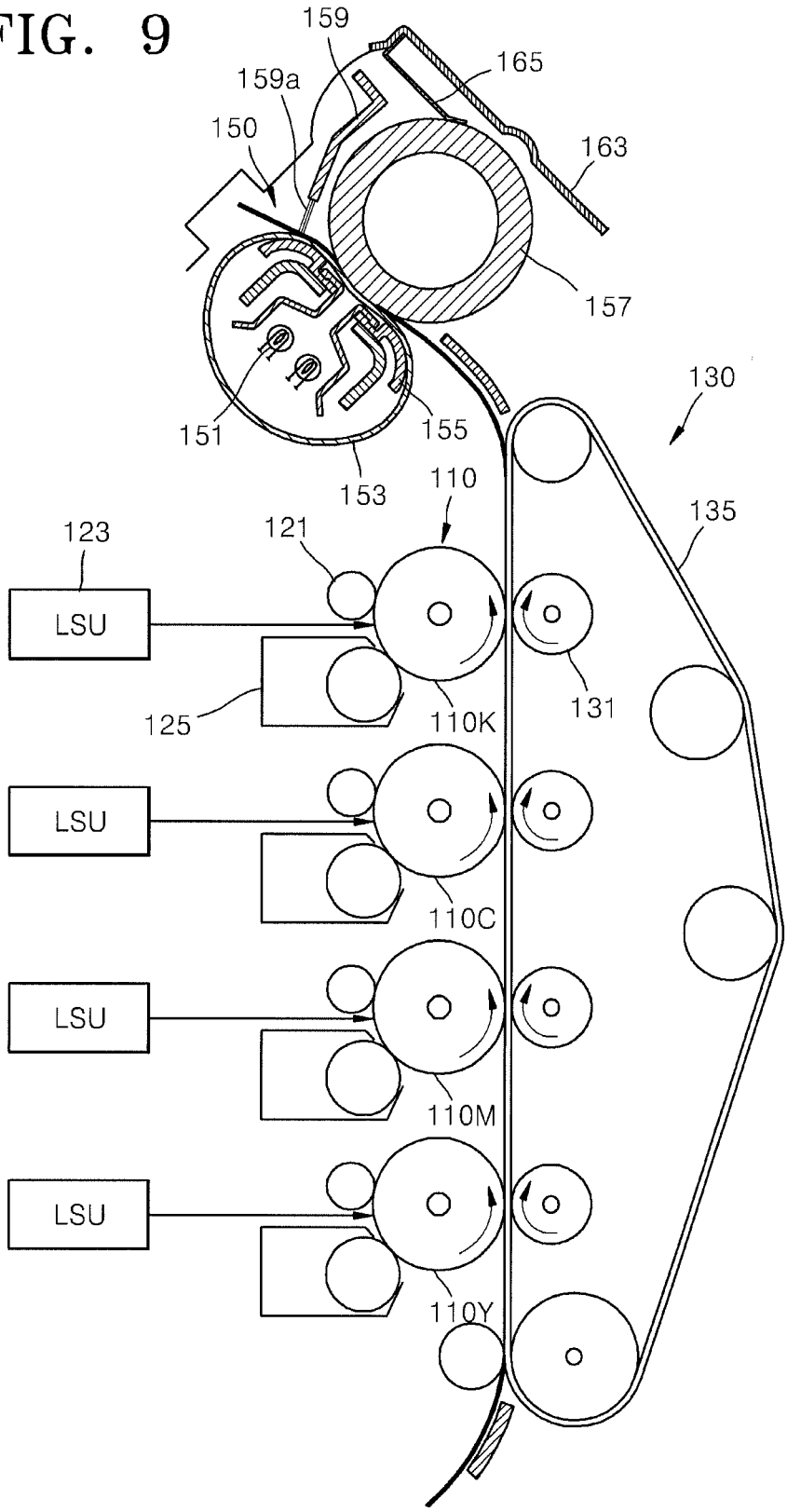
FIG. 9 illustrates an image forming apparatus according to the exemplary embodiment.

FIG. 9 illustrates an image forming apparatus according to the exemplary embodiment.

Referring to FIG. 9, the image forming apparatus according to the exemplary embodiment includes a tandem type electrophotographic image forming apparatus which transfers an image formed in each color to a print medium in a single pass. The image forming apparatus includes a plurality of image carriers 110 which is spaced from each other on a print path and is provided in each color, an exposing unit 123 which forms a latent image in each of the image carriers 110, a developing unit 125 which forms a visible image in each of the image carriers 110, a transfer unit 130 and a fusing unit 150. The image forming apparatus may further include a charger 121 which charges the image carriers 110 by a predetermined electric potential.

The exposing unit 123 exposes the image carriers 110 charged by the charger 121 and forms a latent image, and may include a light scanning unit (LSU) to scan light corresponding to an image to be formed on the print medium.

The developing unit 125 is provided in each color, supplies a developer to the image carriers 110 having a latent image formed thereon, and forms the visible image on the image carriers 110.

The transfer unit 130 transfers the visible image to the print medium M along the print medium moving path. The transfer unit 130 includes a plurality of transfer rollers 131. Each of the plurality of transfer rollers 131 faces each of the image carriers 110 and forms a transfer nip between the transfer rollers 131 and the image carriers 110. In FIG. 9, the image carriers 110 include first to fourth image carriers 110Y, 110M, 110C and 110K. The plurality of transfer rollers 131 may be respectively provided facing the first to fourth image carriers 110Y, 110M, 110C and 110K. The transfer unit 130 may further include a transfer belt 135 which passes between the plurality of image carriers 110 and the plurality of transfer rollers 131 and moves the print medium M.

The fusing unit 150 fuses to the print medium M the visible image transferred from the transfer unit 130. The configuration and the operation of the fusing unit 150 is substantially the same as those of the fusing unit according to the exemplary embodiment, and thus detailed description will be avoided.

The electrophotographic image forming apparatus according to the exemplary embodiment includes a tandem color image forming apparatus but not limited thereto. The image forming apparatus according to the embodiment may further include a multi-pass color image forming apparatus forming an image by using a single image carrier and a mono image forming apparatus forming a single color image within the scope including the configuration of the fusing unit 150 in common.

With the foregoing configuration, the fusing unit and the image forming apparatus employing the same according to the embodiment may prevent instant discharge due to contact between the print medium and the heating member when the print medium is escaped from the fusing nip to thereby prevent a defect of an image due to such instant discharge.

As the configuration of applying the voltage to the pressure roller and the discharging plate on the print medium moving path between the transfer roller and the fusing unit are excluded, the fusing unit according to the embodiment has a simpler configuration than the conventional fusing unit including such discharging plate and the configuration of applying the voltage to the pressure roller.

Although a few exemplary embodiments have been shown and described, it will be appreciated by those skilled in the art that changes may be made in these exemplary embodiments without departing from the principles and spirit of the embodiments, the scope of which is defined in the appended claims and their equivalents.

What is claimed is:

1. A fusing unit which is mounted in an image forming apparatus and fuses an image transferred to a print medium, the fusing unit comprising:

a fusing frame which is grounded to the image forming apparatus when mounted in the image forming apparatus;

a heating member which transfers heat from a heat source provided therein to a print medium passing a predetermined fusing nip;

a supporting member, located in the heating member, which rotatably supports the heating member;

a pressure roller which is installed to be grounded to the fusing frame, forms the fusing nip between the pressure roller and the heating member, presses the print medium passing the fusing nip and comprises a conductive material; and a discharging member which is installed to be grounded to the fusing frame, and comprises an end part which contacts the print medium passing the fusing nip, and discharges static electricity from the print medium, wherein a surface resistance of the pressure roller ranges from about 105Ω to 107Ω.

2. The fusing unit according to claim 1, wherein an end part of the discharging member is located a predetermined distance from a starting point toward an axis X if an end part of the fusing nip being escaped by the print medium is referred to as the starting point and a segment connecting a center of the heating member and a center of the pressure member passing the contact location of the discharging member and the heating member is referred to as the axis X.

3. The fusing unit according to claim 2, wherein the predetermined distance is about 5.00 mm.

4. The fusing unit according to claim 1, wherein the heating member comprises:

a release layer contacting the print medium and comprising a non-conductive material; and a heat transfer layer provided within the release layer, grounded to the fusing frame and comprising a conductive material.

5. The fusing unit according to claim 4, wherein the heating member further comprises:

a first primer layer;

a base layer; and a second primer layer, wherein the heat transfer layer is provided to face the heat source and to absorb the heat from the heat source, and the base layer is interposed between the first primer layer and the second primer layer.

6. The fusing unit according to claim 4, wherein the release layer comprises a non-conductive fluoropolymer.

7. The fusing unit according to claim 1, further comprising a bias plate which is provided in a first side of the pressure roller and electrically connected to the fusing frame, and a conductive brush which electrically connects the pressure roller and the bias plate.

8. The fusing unit according to claim 1, wherein the heating member comprises a flexible endless belt, and the supporting member faces the pressure roller interposing the endless belt therebetween.

9. The fusing unit according to claim 8, wherein the heating member rotates in association with a rotation of the pressure roller.

10. The fusing unit according to claim 1, wherein the supporting member comprises a bushing part.

11. An image forming apparatus, comprising:

an image carrier;

an exposing unit which forms an electrostatic latent image on the image carrier;

a developing unit which develops a toner image with respect to the electrostatic latent image formed on the image carrier;

a transfer unit which transfers to a print medium the toner image formed on the developing unit; and a fusing unit which fuses a non-fused toner image transferred to the print medium according to claim 1.

12. The image forming apparatus according to claim 11, wherein an end part of the discharging member is located a predetermined distance away from a starting point toward an axis X if an end part of the fusing nip being escaped the print medium is referred to as the starting point, and a segment connecting a center of the heating member and a center of the pressure member passing the contact location of the discharging member and the heating member is referred to as the axis X.

13. The image forming apparatus according to claim 12, wherein the predetermined distance is about 5.00 mm.

14. The image forming apparatus according to claim 11, wherein the heating member comprises:

a release layer contacting the print medium and comprising a non-conductive material; and a heat transfer layer provided within the release layer, grounded to the fusing frame and comprising a conductive material.

15. The image forming apparatus according to claim 11, wherein the fusing unit further comprises a bias plate which is provided in a first side of the pressure roller and electrically connected to the fusing frame, and a conductive brush which electrically connects the pressure roller and the bias plate.

16. The image forming apparatus according to claim 11, wherein the heating member comprises a flexible endless belt, and the supporting member faces the pressure roller interposing the endless belt.

17. The image forming apparatus according to claim 16 wherein the heating member rotates in association with a rotation of the pressure roller.

* * * * *